United States Patent [19]

McDonald et al.

[11] Patent Number: 4,902,199

[45] Date of Patent: Feb. 20, 1990

[54] UNIVERSAL BLOWER

[75] Inventors: Russell McDonald, Rochester; John A. Wargo, Macedon; Glenn M. Herbert; Kenneth P. Moore, both of Rochester; John D. Gramlich, Webster, all of N.Y.

[73] Assignee: Xerox Corporation, Stamford, Conn.

[21] Appl. No.: 918,456

[22] Filed: Oct. 14, 1986

[51] Int. Cl.[4] ..... F04D 29/30

[52] U.S. Cl. ..... 415/143; 415/99; 415/912

[58] Field of Search ..... 415/198.1, 143, 99, 415/101, 102, DIG. 3, 912

[56] References Cited

U.S. PATENT DOCUMENTS

| | | | |
|---|---|---|---|
| 1,456,051 | 5/1923 | Carter | 415/99 X |
| 2,277,333 | 3/1982 | Leopold | 415/DIG. 3 |
| 2,701,530 | 2/1955 | Schellerer | 415/99 X |
| 2,916,997 | 12/1959 | Terrie | 415/198.1 |
| 3,469,772 | 7/1967 | McDonald | 415/101 |
| 3,543,368 | 12/1970 | Marlow | 29/156.8 |
| 3,841,791 | 10/1974 | Doolin | 415/DIG. 3 X |
| 3,924,963 | 12/1975 | Zerrer | 415/198.1 X |
| 3,935,625 | 2/1976 | Saterdal | 415/912 |
| 3,946,648 | 3/1976 | Schneider | 415/912 |
| 4,101,243 | 7/1978 | Tatkov et al. | 415/198.1 X |
| 4,102,596 | 7/1978 | Itayama | 415/101 |
| 4,115,038 | 9/1978 | Litzenberg | 415/DIG. 3 X |
| 4,668,166 | 5/1987 | Lutz | 415/912 |
| 4,688,293 | 8/1987 | McCambridge | 415/DIG. 3 |
| 4,695,225 | 9/1987 | Hellat et al. | 415/912 |

FOREIGN PATENT DOCUMENTS

| | | | |
|---|---|---|---|
| 186560 | 10/1905 | Fed. Rep. of Germany | 415/99 |
| 495697 | 3/1976 | U.S.S.R. . | |
| 515124 | 11/1939 | United Kingdom | 415/99 |

OTHER PUBLICATIONS

Xerox Disclosure Journal, vol. 7, No. 1, p. 13, Jan./Feb. 1982, Browne.

*Primary Examiner*—Robert E. Garrett
*Assistant Examiner*—John T. Kwon
*Attorney, Agent, or Firm*—H. Fleischer; J. E. Beck; R. Zibelli

[57] ABSTRACT

A multifunction blower in which a common housing is employed to both increase and decrease the pressure of incoming air in separate chambers thereof. The increase and decrease in air pressure is adjustable by changing the impellers of the pressure and vacuum assemblies used therein.

8 Claims, 2 Drawing Sheets

UNIVERSAL BLOWER

This invention relates generally to an apparatus for moving air, and more particularly concerns a dual configuration air blowing having the capability of reducing or increasing the air pressure independently.

Various forms of conventional air blowers have incorporated rotating impellers or defusers having complementary surfaces and configurations in a housing chamber intermediate an intake or suction passage and a discharge passage. A device of this type is generally driven by a motor or engine having a selected power output while the discharge devices or blowers are conventionally manufactured with a variety of housings and impeller constructions to match the different required pumping characteristics and horse power characteristics. Preferably, it is desirable to be capable of utilizing the same housing with different impellers to achieve the desired air pressure, i.e. either a reduction or increase in the air pressure.

There have been various types of devices developed to achieve the foregoing. The following discloses appear to be relevant:

U.S. Pat. No. 3,469,772
Patentee: McDonald
Issued: Sept. 30, 1969
U.S. Pat. No. 3,543,368
Patentee: Marlow
Issued: Dec. 1, 1970
U.S. Pat. No. 4,102,596
Patentee: Itayama
Issued: July 25, 1978
Russian Patent No. 495697
Patentee: Livshin
Published: Mar. 16, 1976

The relevant portions of the foregoing disclosures may be briefly summarized as follows:

McDonald discloses a dual configuration air moving apparatus. Two individual fan elements are mounted on a common shaft with a single motor mounted therebetween.

Marlow describes a single impeller fluid discharge device using a single rotating impeller within a fixed housing. The impeller may be selectively changed to vary the pumping characteristic and horse power requirements.

Itayma discloses a dual impeller fan device with separate suction and exhaustion chambers. The impellers are mounted upon a single shaft and rotate in the same direction. The casing is cylindrical in shape.

Livshin et al. describes a ventilation fan encasement assembly permitting easy modification to accommodate a wide range of blower sizes.

In accordance with one aspect of the present invention, there is provided an apparatus for moving air. The apparatus includes a housing defining a pair of chambers for receiving air therein. Means, associated with one of the chambers in the housing, decreases the pressure of the air received in that chamber. The decreasing means is mounted replaceably in one of the chambers enabling the decrease in air pressure to be adjusted. Means, associated with the other one of the chambers, increases the pressure of the air received in that chamber. The increasing means is mounted replaceably in the other one of the chambers enabling the increase in air pressure to be adjusted.

Figure 1:
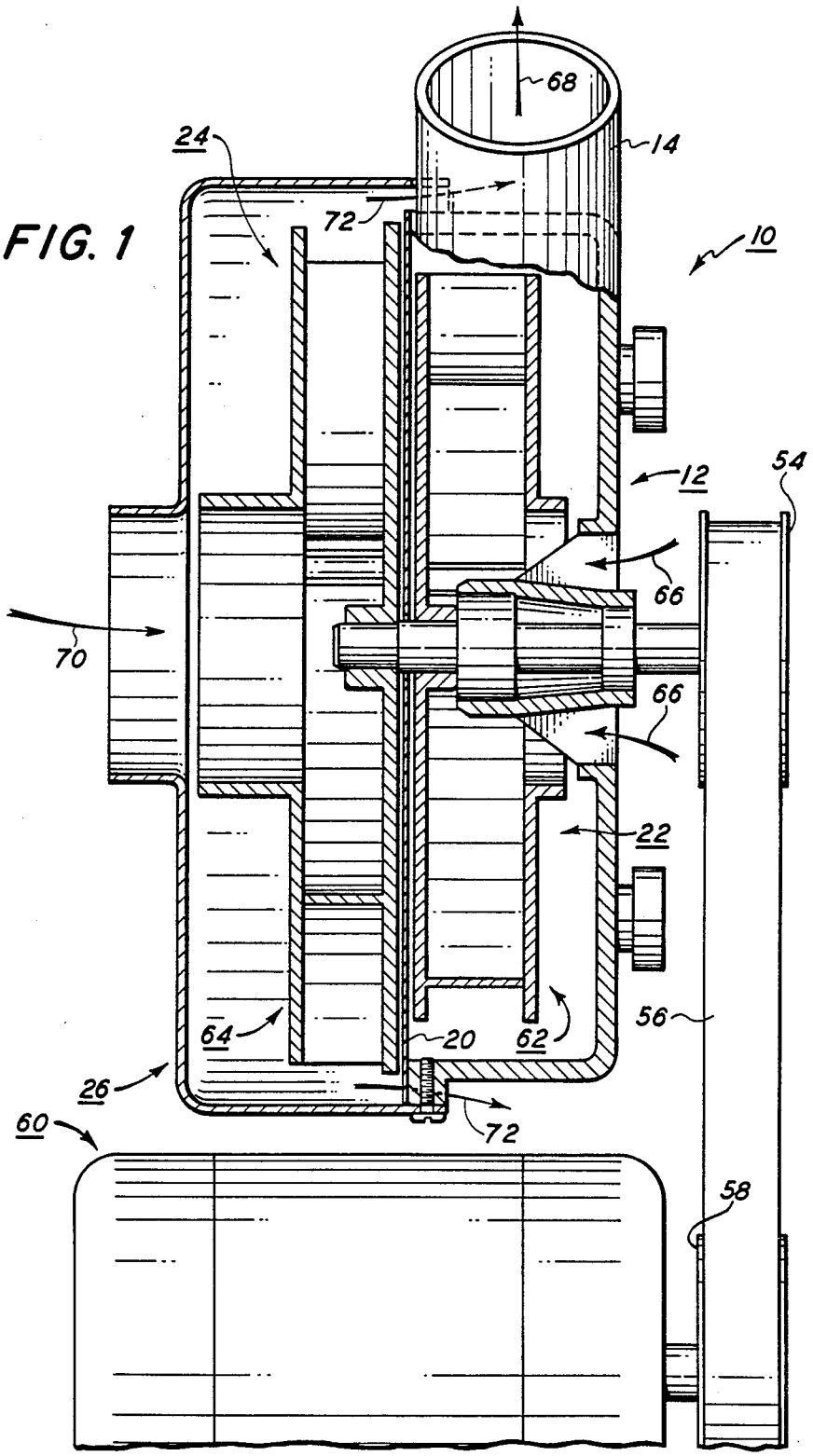
Figure 2:
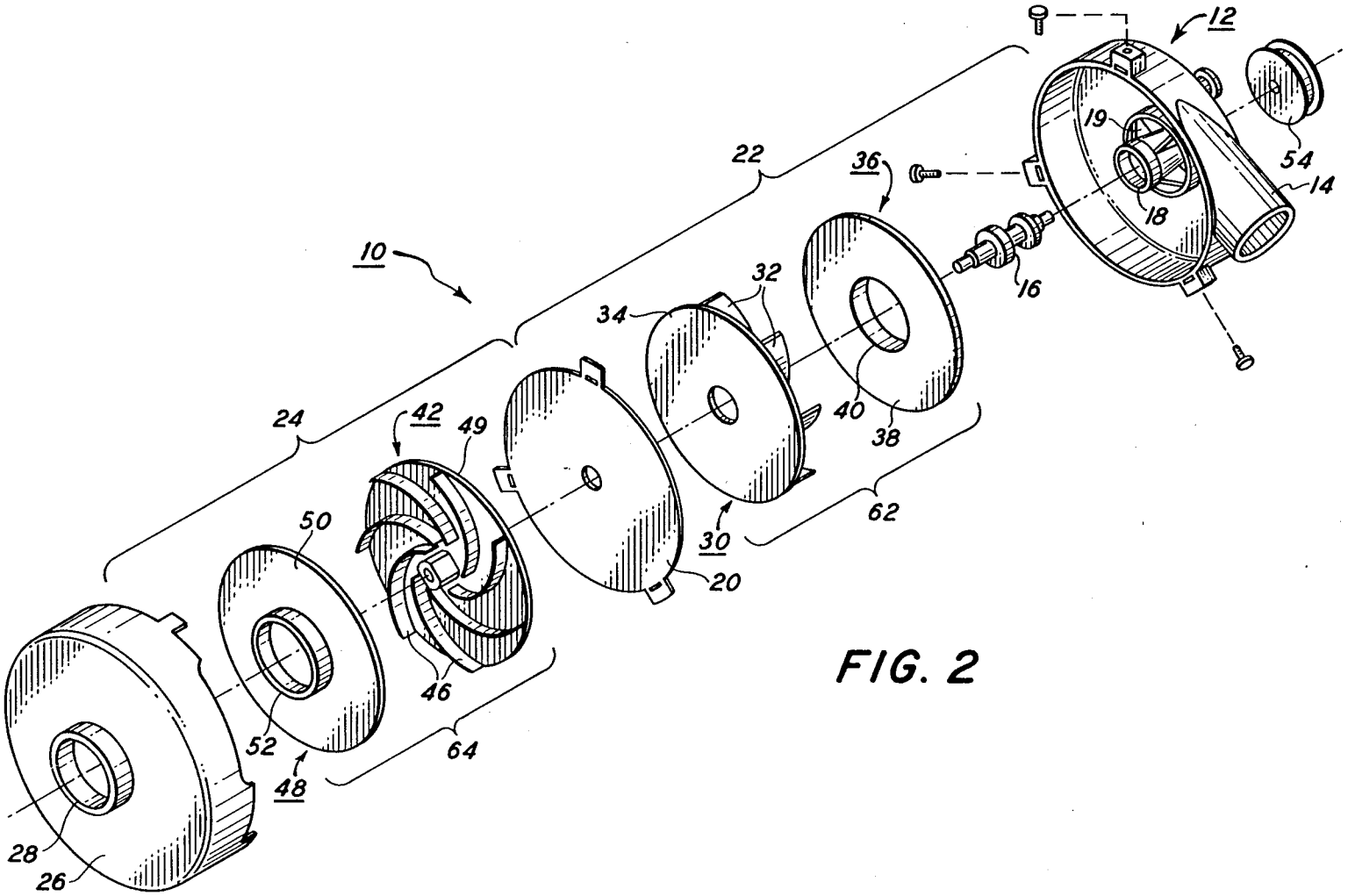

Other features of the present invention will become apparent as the following description proceeds and upon reference to the drawings, in which:

FIG. 1 is a schematic, elevational view showing a blower incorporating the features of the present invention therein; and FIG. 2 is an exploded perspective view of the FIG. 1 blower.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Turning initially to FIG. 1, there is shown a blower, indicated generally by the reference numeral 10, having a housing, indicated generally by the reference numeral 12, defining a chamber 22. A pressure assembly, indicated generally by the reference numeral 62, is mounted in chamber 22. A cover, indicated generally by the reference numeral 26, defines a chamber 24. A vacuum assembly, indicated generally by the reference numeral 64, is mounted in chamber 24. Plate 20 separates chamber 22 from chamber 24. Pressure assembly 62 and vacuum assembly 64 are mounted on a common shaft having pulley 54 located at one end thereof. A drive belt 56 couples pulley 54 to pulley 58 mounted on a motor, indicated generally by the reference numeral 60. Energization of motor 60 rotates pressure assembly 62 and vacuum assembly 64. As pressure assembly 62 rotates, air flows in the direction of arrow 66 into chamber 22. Pressurized air exits from chamber 22 through tube 14 in the direction of arrow 68. As vacuum assembly 64 rotates, air flows in the direction of 70 into chamber 24. The air entering chamber 24 is at a negative pressure. Air exits from chamber 24 from the exit region in the direction of arrow 72

Referring now to the FIG. 2, there is shown an exploded perspective view of the FIG. 1 blower. Blower 10 includes a housing 12 having a tubular portion 14 for emitting air therefrom. Air enters chamber 22 at inlet 19. Pressurized air exits from chamber 22 from tubular portion 14. A shaft assembly 16 is supported by a conical region 18 of housing 12. Separator plate 20 is positioned in housing 12 to define chambers 22 and 24 respectively therein. Cover 26 closes housing 12 to chambers 22 and 24 with separator plate 20 being interposed therebetween. Shaft assembly 16 is supported by a pair of spaced bearings mounted in housing 12. Pressure assembly 62 in chamber 22 moves air in order to create a positive pressure at the outlet thereof, i.e. tubular portion 14. Vacuum assembly 64 in chamber 24 moves air to create a negative pressure at the inlet thereof, i.e. tubular portion 23. Pressure assembly 62 and vacuum assembly 64 are mounted on shaft 16 and rotate in unison therewith. Pressure assembly 62 includes an impeller indicated generally by the reference numeral 30, having a cover plate, indicated generally by the reference numeral 36 mounted thereon. Impeller 30 is mounted on shaft assembly 16 in chamber 22. Impeller 30 has a plurality of convolute vanes 32 extending outwardly from disc 34. Vanes 32 are configured to increase the pressure of the air in chamber 22 when impeller 30 is rotating with shaft 16. Pressure cover plate 36 is mounted on impeller 30 adjacent vanes 32. Pressure cover plate 36 includes a ring-shaped disc 38 having a transition tube 40 extending outwardly therefrom toward housing 12 away from vanes 32. The length of transition tube 40 is adapted to accommodate a wide range of impellers. Thus, depending upon the selected air pressure, different impellers may be used in pressure assembly 62 and inserted in chamber 22 to achieve the selected air pressure exiting therefrom.

Vacuum assembly 64 is mounted on shaft 16 in chamber 24. Vacuum assembly 64 includes an impeller, indicated generally by the reference numeral 42, having a cover plate, indicated generally by the reference numeral 48, mounted thereon. Impeller 42 includes a disc 44 having convolute vanes 46 extending outwardly therefrom. The configuration of vanes 46 is such that a vacuum or negative or reduced air pressure is formed in chamber 24 and at the inlet thereof at tubular portion 28 of cover 26. The air exiting from chamber 24 is at about atmospheric pressure. Impeller 42 is mounted on shaft 16 and rotates therewith. Vacuum cover plate 48 is mounted on impeller 42 adjacent vanes 46. Vacuum cover plate 48 includes a ring-shaped disc 50 having a transition tube 52 extending outwardly therefrom on the side thereof opposed from vanes 46 of impeller 42. The length of transition tube 52 of cover plate 48 is adapted to accommodate a wide range of different impellers 42. Thus, depending upon the desired vacuum, different impellers may be used in vacuum assembly 64 and inserted in chamber 24 to achieve the selected vacuum of the entering air. Hence, the vacuum and pressure assemblies are readily replaceable in blower 10 to achieve the desired increase and/or reduction in air pressure. This interchangeability produces a universal blower capable of being used for a wide variety of vacuum and pressure applications.

Preferably, all of the components of the blower are made from plastic. However, one skilled in the art will appreciate that many other suitable materials may also be employed.

In recapitulation, it is apparent that the universal blower of the present invention is multifunctional in that it is capable of producing both a vacuum, i.e. air incoming at a decreased pressure, and pressurized air, i.e. air exiting at an increased pressure. The blower employs a vacuum and a pressure assemblies which are easily replaceable in the blower to select the desired pressures. In this way, the blower may be employed for a large range of pressures and vacuums. Thus, a common housing and common parts may be used to achieve a significant cost reduction in the manufacturing of a blower made substantially from plastic parts. The simple replaceability of the vacuum and pressure assemblies with selected impellers significantly reduces the cost of the blower in that the remaining parts are common independent of the desired pressure and vacuum ranges.

It is, therefore, apparent that there has been provided in accordance with the present invention, a multifunction blower that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all alternatives, modifications and variations as fall within the spirit and broad scope of the appended claims:

We claim:

1. An apparatus for moving air, including:

a housing defining a pair of chambers for receiving air therein;

a vacuum assembly mounted in said one of the chambers in said housing, said vacuum assembly being readily replaceable with another vacuum assemble having a different capacity than said first mentioned vacuum assembly so as to enable the air pressure in said one of the chambers to be adjusted without adjusting the size of said one of the chambers in said housing; and a pressure assembly mounted in said other one of the chambers in said housing, said pressure assembly being readily replaceable with another pressure assemble having a different capacity than said first mentioned pressure assembly so as to enable the air pressure in said other one of the chambers to be adjusted without adjusting the size of said other one of the chambers in said housing.

2. An apparatus according to claim 1, wherein said vacuum assembly includes:

a replaceable vacuum impeller; and a vacuum cover plate mounted on said vacuum impeller.

3. An apparatus according to claim 2, wherein said pressure assembly includes:

a replaceable pressure impeller; and a pressure cover plate mounted on said pressure impeller.

4. An apparatus for moving air, including:

a housing defining a pair of chambers for receiving air therein;

a vacuum assembly mounted in said one of the chambers in said housing, said vacuum assembly being readily replaceable with another vacuum assemble having a different capacity than said first mentioned vacuum assembly so as to enable the air pressure in said one of the chambers to be adjusted, said vacuum assembly comprising a replaceable vacuum impeller and a vacuum cover plate mounted on said vacuum impeller, said vacuum cover plate includes a transition tube being of a length so as to operate with different capacity vacuum impellers; and a pressure assembly mounted in said other one of the chambers in said housing, said pressure assembly being readily replaceable with another pressure assemble having a different capacity than said first mentioned pressure assembly so as to enable the air pressure in said other one of the chambers to be adjusted, said pressure assembly comprising a replaceable pressure impeller and a pressure cover plate mounted on said pressure impeller.

5. An apparatus according to claim 4, wherein said pressure cover plate includes a transition tube being of a length so as to operate with different capacity pressure impellers.

6. An apparatus according to claim 5, wherein said housing includes a separator plate arranged to define said pair of chambers in said housing.

7. An apparatus according to claim 6, further including means for rotating said pressure impeller and said vacuum impeller.

8. An apparatus according to claim 7, wherein said rotating means includes:

a shaft member having said vacuum impeller and said pressure impeller mounted thereon;

a pulley mounted on said shaft external to said housing; and a motor coupled to said pulley for rotating said pulley.

* * * * *